US005820477A

United States Patent [19]

Redkey et al.

[11] Patent Number: 5,820,477

[45] Date of Patent: Oct. 13, 1998

[54] GOLF TRAINING SYSTEM

[76] Inventors: Robert Redkey, 5010 B Baseline Rd., Santa Ynez, Calif. 93460; Morgan Redkey, 6276 Newcastel, Goleta, Calif. 93117

[21] Appl. No.: 859,446

[22] Filed: May 20, 1997

Related U.S. Application Data

[63] Continuation-in-part of Ser. No. 587,651, Jan. 17, 1996, abandoned.

[51] Int. Cl.[6] ..... A63B 69/36

[52] U.S. Cl. ..... 473/236; 473/251

[58] Field of Search ..... 473/219, 223, 473/226, 231, 235, 236, 251, 257, 286

[56] References Cited

U.S. PATENT DOCUMENTS

| | | | |
|---|---|---|---|
| 1,939,414 | 12/1933 | Sametz | 473/226 |
| 3,021,141 | 2/1962 | Polsky et al. | 473/236 |
| 3,194,564 | 7/1965 | Swan | 473/236 |
| 3,489,415 | 1/1970 | Smith | 473/236 |
| 4,139,198 | 2/1979 | Kanavas | 473/236 |
| 4,323,246 | 4/1982 | Nehrbas, Jr. | 473/236 |
| 5,135,228 | 8/1992 | Hawkins, Sr. et al . | 473/236 |
| 5,441,268 | 8/1995 | Shier | 473/236 |
| 5,478,078 | 12/1995 | Lee | 473/236 |

*Primary Examiner*—Steven Wong
*Attorney, Agent, or Firm*—Robert M. Sperry

[57] ABSTRACT

An improved golf training device comprising a base member which is releasably attachable to substantially any conventional golf club, together with a plurality of training aids which are interchangeably attachable to the base member and which each serve to correct respective aspects of a golfer's swing and stroke.

13 Claims, 5 Drawing Sheets

GOLF TRAINING SYSTEM

RELATED CASES

This application is a Continuation-In-Part of my prior patent application, Ser. No. 08/587,651, filed Jan. 17, 1996 and now abandoned.

FIELD OF INVENTION

This invention relates to the game of golf and is particularly directed to improved training means comprising a plurality of training devices which are interchangeably attachable to a putter to improve respective aspects of a golfer's swing.

PRIOR ART

As is well known, putting is a major skill in the game of golf and a player's ability at putting will often determine the outcome of a game. It is also well known that the proper swing or stroke is essential to making a good putt or, in fact, in using any golf club. As a result, golfers spend significant amounts of time practicing putting and swinging golf clubs to improve these skills. Many prior art golfing aids have simulated miniature golf holes to allow a golfer to practice putting at home, in the office or in other locations away from a golf course. Other prior putting aids have been various types of golf clubs which were modified to enhance training, but which would not be allowed in actual play. Some prior art golfing aids have included video cameras to enable the golfer to videotape his stroke and, hence, to analyze his swing. Unfortunately, these video devices have been extremely bulky and expensive. Consequently, they are found only at pro shops, country clubs and the like. Other prior art golfing aids have provided clubs having markings on the club or on an underlying carpet to assist the golfer in lining up his stroke. Unfortunately, virtually all of the prior art golfing aids are designed to correct or modify only one specific type of error, whereas many types of error, such as speed, direction, follow through and relative position of the club face and ball, can contribute to an incorrect stroke. Thus, none of the prior art golfing aids have been entirely satisfactory.

BRIEF SUMMARY AND OBJECTS OF INVENTION

These disadvantages of the prior art are overcome with the present invention and an improved golf training device is provided which in simple and inexpensive to use and can be used virtually anywhere, yet which serves to correct virtually all aspects of a golfer's swing and stroke.

The advantages of the present invention are preferably attained by providing an improved golf training device comprising a base member which is releasably attachable to substantially any conventional golf club, together with a plurality of training aids which are interchangeably attachable to said base member and which each serve to correct respective aspects of a golfer's swing and stroke.

Accordingly, it is an object of the present invention to provide an improve golf training aid.

Another object of the present invention is to provide an improved golf training which in simple and inexpensive to use.

Another object of the present invention is to provide an improved golf training device which can be used virtually anywhere.

An additional object of the present invention is to provide an improved golf training device which serves to correct virtually all aspects of a golfer's swing and stroke.

A specific object of the present invention is to provide an improved golf training device comprising a base member which is releasably attachable to substantially any conventional golf club, together with a plurality of training aids which are interchangeably attachable to said base member and which each serve to correct respective aspects of a golfer's swing and stroke.

These and other objects and features of the present invention will be apparent from the following detailed description, taken with reference to the figures of the accompanying drawing.

DETAILED DESCRIPTION OF THE INVENTION

Figure 1:
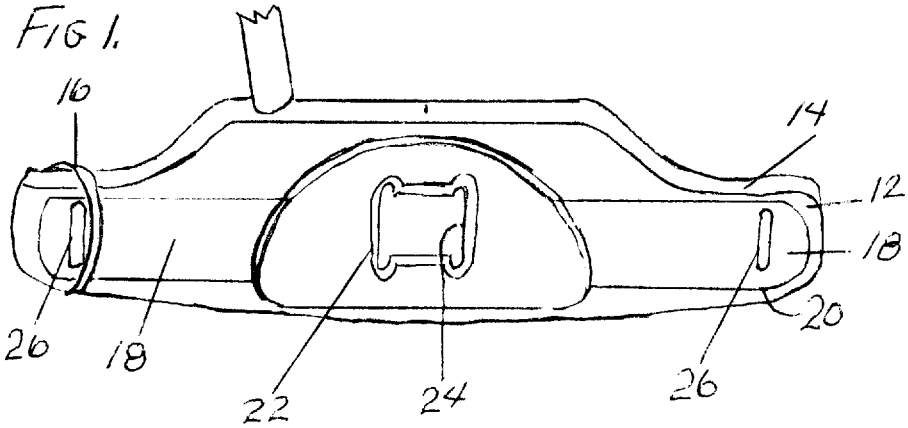
FIG. 1 is a front view of the base member of the golf training device of the present invention, shown releasably mounted on a conventional golf club.
Figure 2:
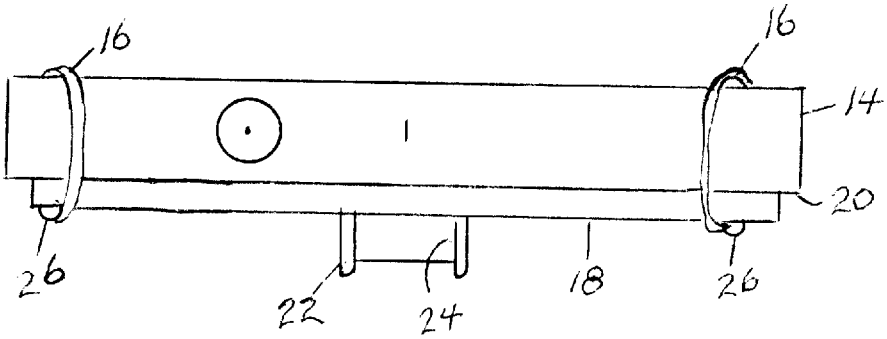
FIG. 2 is a plan view of the base member of FIG. 1.
Figure 3:
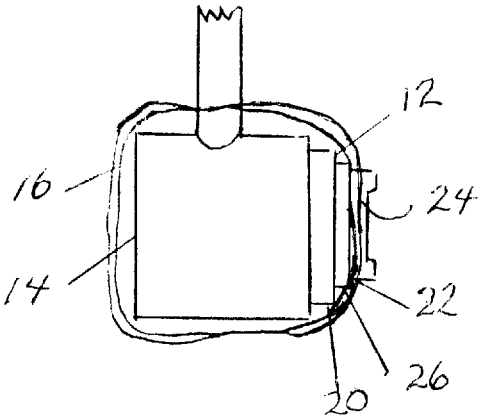
FIG. 3 is a left end view of the base member of FIG. 1.

In that form of the present invention chosen for purposes of illustration in the drawing, FIG. 1 shows a golf club, indicated generally at 10, having a base member 12 releasably attached to the head 14 of the golf club 10 by suitable means, such as elastic bands 16. The base member 12 comprises a flat portion 18, which extends generally parallel to the face 20 of the head 14 of the golf club 10, and carries a stud portion 22 which projects forwardly from the flat portion 18 and is formed with a suitable recess 24. As seen in FIGS. 4–21, a plurality of training aid devices are each formed for frictional engagement with the recess 24 to allow the training aids to be interchangeably mountable on the base member 12. Flanges 26 project forwardly adjacent respective ends of the base member 12 and serve for releasable attachment of the elastic bands 16 to the base member 12.

In use, the golfer attaches the base member to the head 14 of a suitable golf club 10, by slipping the elastic bands 16 about the studs 26 and about the head 14 of the golf club 10 to releasably attach the base member 12 to the head 14 of the golf club 10. Thereafter, the golfer selects a desired one of the training aid devices, shown in FIGS. 4–21, and inserts the tongue of the training aid device into recess 24 of the base member 12 to frictionally, yet releasably, mount the training aid device on the base member 12. As discussed below, each of the training aid devices serves to provide a respective training function. Thus, by selecting a desired one of the training aid devices and interchangeably attaching the desired training aid device, the golfer can practice and work to improve a respective aspect of his swing and stroke. Subsequently, the golfer can remove the training aid device and replace it with another of the training aid devices to work on a different aspect of his stroke and swing. When he has finished practicing, the golfer simply removes the elastic bands 16 from the head 14 of his golf club 10 and can use the golf club 10 for actual play, while the base member 12 and the training aid devices can be stored in his golf bag or other suitable location.

Figure 4:
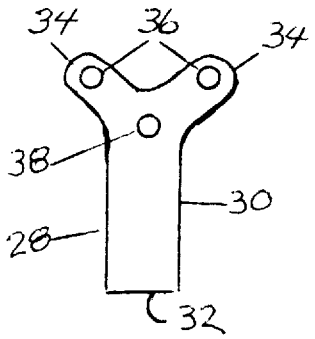
FIG. 4 is a plan view of a first training aid which is interchangeably attachable to the base member of FIG. 1.
Figure 5:
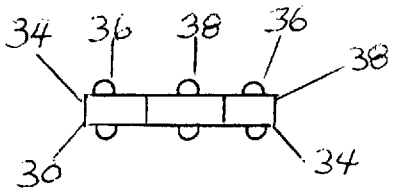
FIG. 5 is a front view of the training aid of FIG. 4.
Figure 6:
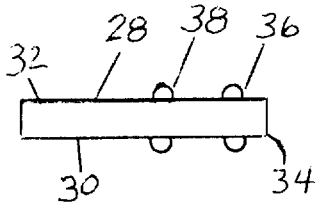
FIG. 6 is a side view of the training aid of FIG. 4.
Figure 7:
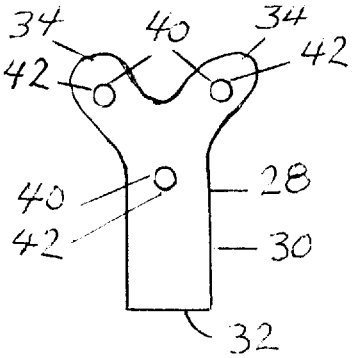
FIG. 7 is a plan view of an alternative form of the training aid of FIG. 4.
Figure 8:
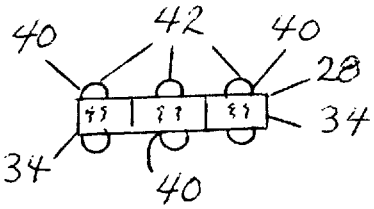
FIG. 8 is a front view of the training aid of FIG. 7.
Figure 9:
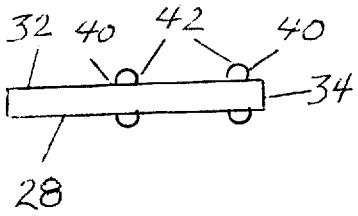
FIG. 9 is a left end view of the training aid of FIG. 7.

FIGS. 4–6 show a first training aid device, indicated generally at 28, which is interchangeably mountable in recess 24 of the base member 12. As shown, the first training aid device 28 comprises a generally Y-shaped member 30 having a tongue portion 32, which is frictionally, yet releasably, insertable into the recess 24 of the base member 12 to releasably mount the first training aid device 28 on the stud 22 of the base member 12. Also, the first training aid device 28 has a pair of arms portions 34 which project forwardly and outwardly from the tongue portion 32 and each carry a tip 36 which projects vertically upward from the plane of the tongue portion 32. Finally, a third tip 38 projects vertically upward from the tongue portion 32 adjacent the intersection of the tongue portion 32 with the arms 34. FIGS. 7–9 show a modified form of the training aid device 28 in which the tongue portion 32 and arms 34 ar formed with threaded holes 40 and the tips 36 and 38 are replaced by screws 42, which can be screwed into or out of the holes 40 to adjust the height of the screws 42 as desired by the golfer.

In use, the first training aid 28 is attached to the recess 24 of the base member 12 and, hence, to the head 14 of the golf club 10. To use the first training aid device 28, the golfer balances a golf ball one the tips 36 and 38 or screws 42 of the first training aid device 28 and swings the golf club 10 in the manner of a putter; that is, the club head 14 moves through a short vertical arc and stops. Since the golf ball is delicately balanced on the three points of the tips 36 and 38 or screws 42, if the arc of the club head 14 is not truly vertical, the golf ball will fall off of the first training aid device 28 in a direction which will indicate the error in the golfer's stroke. When the movement of the club head 14 stops, the weight of the golf ball will cause it to be slung off of the first training aid device 28 and the direction of movement of the golf ball will provide the golfer with another indication of the correctness or lack of correctness of the stroke. By repeated practice with the first training aid device 28, the golfer can significantly improve his putting accuracy.

Figure 10:
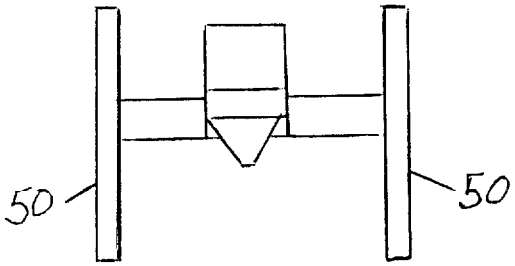
FIG. 10 is a plan view of a second training aid which is interchangeably attachable to the base member of FIG. 1.
Figure 11:
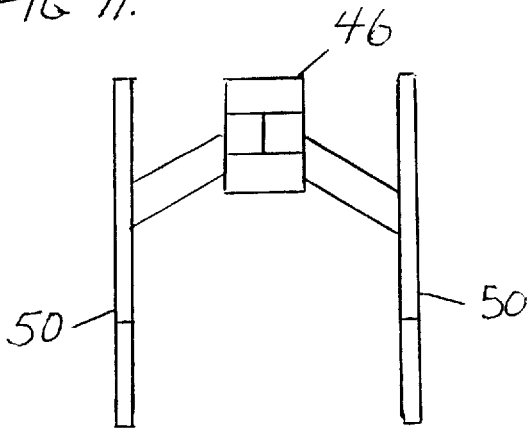
FIG. 11 is a front view of the training aid of FIG. 10.
Figure 12:
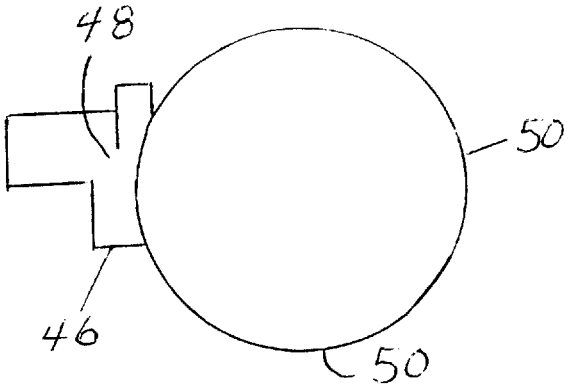
FIG. 12 is a left side view of the training aid of FIG. 10.

FIGS. 10–12 show a second training aid device, indicated generally at 44, having a tongue portion 46 which projects rearwardly from a crossbar 48 and which is frictionally, yet releasably, engageable with recess 24 of the base member 12. Training aid device 44 has a pair of side plates 50 mounted at opposite ends of the crossbar 48 and projecting downwardly from the crossbar 48 a distance slightly greater than the height of a golf ball.

In use, the tongue 46 of the second training aid device 44 is releasably inserted into recess 24 of base member 12 to attach the second training aid device 44 to the head 14 of the golf club 10. Thereafter, the golfer makes a full swing with the golf club 10. If the swing is properly performed, the side plates 50 of the second training aid device 44 will pass on opposite sides of the golf ball without touching it. However, if the arc of the swing is improper or if the club face is turned during the swing, one of the side plates 50 will strike the golf ball and, hence, is indicate to the golfer that the swing was improperly performed. When the golfer can repeatedly swing the golf club 10 with the second training aid device 44 attached, without striking the golf ball, the golfer knows that his swing is correct and that he can drive or use other full swing clubs accurately.

Figure 13:
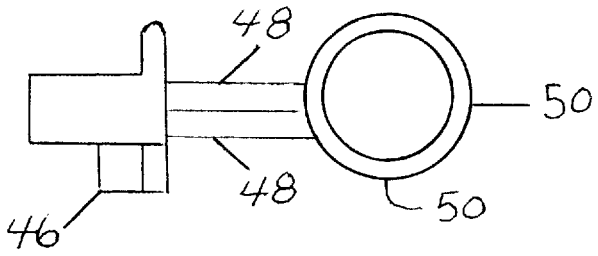
FIG. 13 is a plan view of a third training a which is interchangeably attachable to the base member of FIG. 1.
Figure 14:
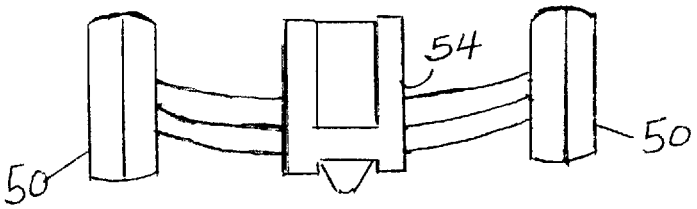
FIG. 14 is a front view of the training aid of FIG. 13.
Figure 15:
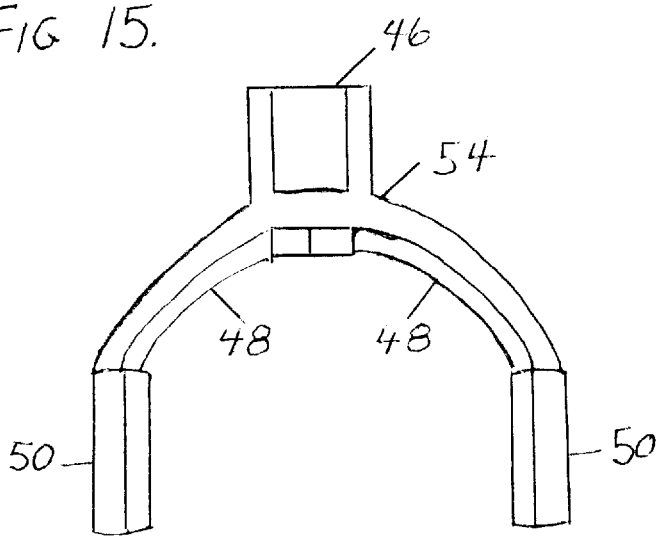
FIG. 15 is a left side view of the training aid of FIG. 13.

FIGS. 13–15 show a third training aid device, indicated generally at 52, which is similar to the second training aid device 44 except that the cross bar 48 carries a generally striker 54 which projects forwardly from the cross bar 48. Also, the length of the side plates 50 is somewhat less than the height of a golf ball.

In use, the third training aid device is swung in the same manner as the second training aid device 44. However, because the side plates 50 are shorter, the third training aid device 52 is intended to actually strike the golf ball. Because the side 18 plates 50 project forwardly of the cross bar 48, unless the face 20 of the golf club 10 is precisely perpendicular to the desired path of the ball when the club 10 is swung, one of the side plates 50 will strike the golf ball early and will cause the golf ball for fly off at an angle to the desired path.

Figure 16:
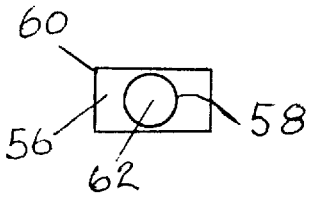
FIG. 16 is a plan view of a fourth training aid which is interhcangeably attachable to the base member of FIG. 1.
Figure 17:
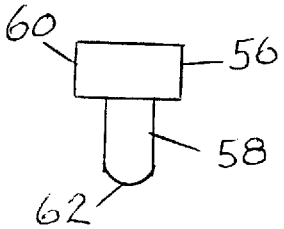
FIG. 17 is a front view of the training aid of FIG. 16.
Figure 18:
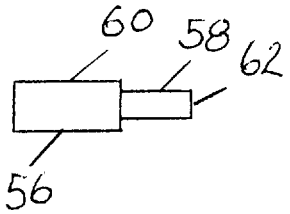
FIG. 18 is a left side view of the training aid of FIG. 16.

FIGS. 16–18 show a fourth training aid device, indicated generally at 56, comprising a generally cylindrical striker member 58 having a generally rectangular tongue portion 60 for releasable insertion into recess 24 of the base member 12.

In use, the fourth training aid device 56 is mounted on the base member 12 by releasably inserting the tongue portion 60 into recess 24 of the base member 12. Obviously, the front end 62 of the striker member 58 presents a very small area for contact with the golf ball. This corresponds to the so-called "sweet spot" of the head 14 of the golf club 10. Consequently, unless the golf club 10 is accurately swung, the front end 62 of the striker member 58 of the fourth training aid device 56 will impact the golf ball in an undesired manner and will cause the golf ball to fly off in a clearly undesired direction, thereby providing an indication to the golfer that the swing had been improper.

Figure 19:
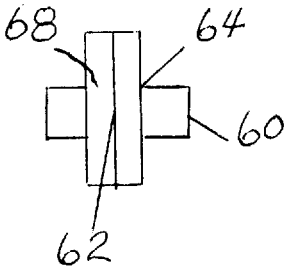
FIG. 19 is plan view of a fifth training aid which is interchangeably attachable to the base member of FIG. 1.
Figure 20:
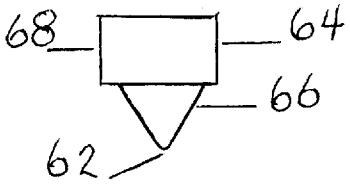
FIG. 20 is a front view of the training aid of FIG. 19.
Figure 21:
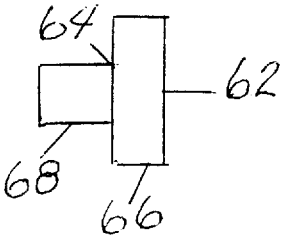
FIG. 21 is a left side view of the training aid of FIG. 19.

FIGS. 19–21 show a fifth training aid device, indicated generally at 64, having a generally triangular striker portion 66 with a generally rectangular tongue portion 68 projecting rearwardly from the striker portion 66.

In use, the tongue portion 68 is releasably insertable into recess 24 of the base member 12 to releasably attach the fifth training aid device 64 to the base member 12. Since the triangular striker portion 66 provides only a line contact with the golf ball, it is obvious that the golf club must be swung with extreme precision in order to hit the golf ball in a desired direction. For highly skilled golfers, such as professionals, the fifth training aid device 64 is extremely useful in fine tuning the golfer's swing.

By appropriately selecting a desired one of the training aid devices, the golfer can choose to work on a specific aspect of his swing or stroke and, as his skill increases, can vary the accuracy required for making a correct swing. Obviously, numerous other types of training aid devices can be made for interchangeable use with the base member 12. Also, if desired, the base member 12 could be formed integral with a golf club. In addition, numerous other variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A golf training device comprising:

a golf club having a head, a plurality of training aid devices interchangeably attachable to said head and each serving to correct a respective aspect of a golfer's stroke, and attaching means carried by said head for releasably mounting any of said training aid devices on said head, said attaching means comprises a base member extending generally parallel to said head and having a stud projecting forward from said base member formed with a recess, and each of said training aid devices having a tongue portion frictionally, yet releasably, insertable into said recess.

2. The golf training device of claim 1 wherein:

said attaching means is releasably attachable to said head.

3. The golf training device of claim 2 wherein:

said attaching means comprises a base member extending generally parallel to said head and having a stud projecting forward from said base member formed with a recess, and each of said training aid devices having a tongue portion frictionally, yet releasably, insertable into said recess.

4. The golf training device of claim 2 further comprising:

flanges formed adjacent respective ends of said base member and projecting forwardly therefrom, and elastic bands engaging said flanges and extending about said head to releasably attach said base member to said head.

5. The golf training device of claim 1 wherein:

at least one of said training aid devices is generally Y-shaped having a tongue portion for releasable engagement with said attaching means and having arms extending forwardly and outwardly from one end of said tongue portion, and tip means located on each of said arms and on said tongue portion adjacent the intersection of said tongue portion with said arms and projecting upward to allow a golf ball to be balanced on said tip means.

6. The golf training device of claim 5 wherein:

said tip means are screws and said training aid device is formed with threaded holes for receiving said screws.

7. The golf training device of claim 1 wherein:

at least one of said training aid devices has a crossbar with a tongue portion projecting rearwardly from said crossbar for releasable engagement with said attaching means and having a pair of side plates each mounted on a respective end of said crossbar and projecting downwardly therefrom.

8. The golf training device of claim 7 wherein:

said side plates project downward a distance slightly greater than the height of a golf ball.

9. The golf training device of claim 7 wherein:

said side plates project forwardly of said crossbar.

10. The golf training device of claim 7 wherein:

said crossbar extends parallel to said head.

11. The golf training device of claim 7 wherein:

said side plates project downward a distance slightly less than the height of a golf ball and said crossbar carries a striker located centrally thereof projecting forward from said crossbar.

12. The golf training device of claim 1 wherein:

at least one of said training aid devices is formed with a tongue portion releasably engageable with said attaching means and has a generally cylindrical portion projecting forwardly from said tongue portion.

13. The golf training device of claim 1 wherein:

at least one of said training aid devices is formed with a tongue portion releasably engageable with said attaching means and has a generally triangular member having its point projecting forwardly from said tongue portion.

* * * * *